United States Patent [19]

Murphy

[11] Patent Number: 4,521,774

[45] Date of Patent: Jun. 4, 1985

[54] RASTER CRT HAVING BALANCED PEL DISTRIBUTION FOR FLICKER REDUCTION

[75] Inventor: Alan S. Murphy, Chandler's Ford, England

[73] Assignee: International Business Machines Corporation, Armonk, N.Y.

[21] Appl. No.: 322,819

[22] Filed: Nov. 19, 1981

[30] Foreign Application Priority Data

Nov. 28, 1980 [EP] European Pat. Off. ..... 80304653.1

[51] Int. Cl.[3] ..... G09G 1/16

[52] U.S. Cl. ..... 340/745; 340/728; 340/791; 340/724

[58] Field of Search ..... 358/138, 242; 340/791, 340/789, 728, 724, 723, 745, 744, 748

[56] References Cited

U.S. PATENT DOCUMENTS 3,418,518 12/1968 Reese, Jr. ..... 340/724

OTHER PUBLICATIONS

IBM Technical Disclosure Bulletin, vol. 21, No. 4, Sep. 1978, pp. 1673–1674, "Reduction of Flicker in Interlaced CRT Data Displays", B. F. Dowden.

IBM Technical Disclosure Bulletin, vol. 21, No. 4, Sep. 1978, p. 1675, "Flicker Reduction in Interlaced CRT Data Displays", J. H. Boal et al.

IBM Technical Disclosure Bulletin, vol. 19, No. 12, May 1977, pp. 4796–4797, "Raster Scan CRT Display", J. G. Axford.

*Primary Examiner*—Marshall M. Curtis

*Attorney, Agent, or Firm*—Frederick D. Poag

[57] ABSTRACT

A raster-scanned CRT device includes auxiliary vertical deflection means operable during each scan line of the raster to deflect the electron beam selectively between adjacent pairs of uniformly spaced image lines on the screen. Control logic operates in response to video information representing an image to be displayed to write image pels on the screen during two successive field scans of the raster. The auxilliary deflection means is controlled so that the entire image is formed on the image lines, and the field scan in which the pels are allocated for display is selected on-the-fly for successive portions of the input video in such a way that pel imbalance between the two fields constituting the final image is minimized.

6 Claims, 4 Drawing Figures

```
LO .....................................................
LI .........ABABABA.......................B.............
LO ............A..........................A.............
LI ............B..........................B.............
LO ............A......BABA......BABA....BABBA...........
LI ............B.....A....B....A..........A.............
LO ............B.....BBABAB....AB.........A.............
   ............A.....A...........AB.......B.............
   ............A.....A............A.......B.............
   ............B......BABAB...ABAB........AB............
   .....................................................
   .....................................................
   .....................................................
   ...ABA...............................................
LI ....B..............................................
   ....A..............................................
   ....B......AB.BA....ABAB......ABA.A...ABAB............
   ....A.....B..A..B.......A....B...B...B....A...........
   ....B.....B..B..B...ABABA....A...B...BBABAB...........
   ....A.....A..A..A..B....B....B..AA...A................
   ....B.....A..A..A..A....B.....BA.B...B...........BB...
LO ...AAB....B..B..B...BABAAB..A....A...ABABA......AA...
   ...............................BABA...................
   .....................................................
   .....................................................
   ...BAB.......A.......BABA....BABABA......BA...BABABAB.
   ..B...A.....BA......B....A.......B......B.A...A.......
   .A.....B...A.B.....A.....B......A......A..B...B.......
   .A.....B.....B..........A......BA.....B...A...ABABA...
   .B..A..A.....A.........B.........B...A....B........B..
   .A.....A.....A.........B...........A..ABABABB........A.
   .B.....B.....B.......A............B.......A.........B.
   ..A...A......B......A.......B....A........B........A..
   ...BAB.......A.....BBABABA...ABAB.........A...BABAB...
   .....................................................
   .....................................................
   BBBBBBBBBBBBBBBBBBBBBBBBBBBBBBBBBBBBBBBBBBBBBBBBBBBBB
   AAAAAAAAAAAAAAAAAAAAAAAAAAAAAAAAAAAAAAAAAAAAAAAAAAAAA
   BABABABABABABABABBBBBBBBBBBBBBBBBBBBBBBBBBBBBBBBBBBBB
   ................AAAAAAAAAAAAAAAAAAAAAAAAAAAAAAAAAAAA
   ......................................BABABABABABABABA
   .....................................................
   B.B.B.B.B.B.B.B.B.B.B.B.B.A.B.A.B.A.B.A.B.A.B.A.B.A.B.A.
   .A.A.A.A.A.A.A.A.A.A.A.A.............................
   ...............................BB.......BB.......BB...
LI-BA..BA..BA..BA..BA..BA..BA.....AA.......AA.......AA...
LO-.....................................................
LI-BABABABABABABABABABABABABABABABABABABABABABABABABABA
```

FIG. 3

RASTER CRT HAVING BALANCED PEL DISTRIBUTION FOR FLICKER REDUCTION

FIELD OF THE INVENTION

The invention relates to apparatus for the reduction of perceived flicker in a raster-scanned CRT display device.

BACKGROUND OF THE INVENTION

A common method for the reduction of flicker on CRT display screens at readily achievable refresh rates is to use 'interlace' where a single frame of the image is displayed as two fields, the first containing odd raster lines and the second even raster lines. The image of the first field is reinforced by the image of the second field and, upon rapid refresh, the finite persistence of the CRT phosphor produces a stable image. By this means, flicker frequency is increased from the frame to the field frequency and is consequently less obtrusive.

In order to fully realize this advantage of interlace, the displayed image should be equally distributed over the two interlaced fields. In the case of data displays, for example, where an image is represented on the screen by a plurality of individual visible picture elements (pels), the effect of interlace can be diminished due to the non-random nature of the images. This leads to an unequal distribution of pels between the fields resulting in increased perception of flicker, the frequency of which appears to be at the frame frequency.

Various techniques have been employed to overcome this problem with varying degrees of success. Thus, one method of equalizing the energy content of the two interlaced fields is that known as 'double-dotting'. Here the information content of each field is duplicated so that every horizontal stroke forming a character in the displayed image is produced by two individual raster scan lines, one from each of the two interlace fields. The disadvantage of this system of flicker reduction is that either the displayed image must be limited to relatively large characters because of the pel duplication in the vertical scan direction or suffer from a loss of resolution. Neither of these constraints are acceptable to modern day visual display unit (VDU) users who demand the capability to display small characters without a reduction of resolution.

An alternative approach to the double-dotting method of flicker reduction is described in IBM Technical Disclosure Bulletin Vol. 21, No. 4, September 1978 at page 1673 entitled 'Reduction of Flicker in Interlaced CRT Data Displays' by B. F. Dowden. (IBM is a registered trademark of International Business Machines Corporation). The technique described in this article to ensure a more even distribution of pels between the two interlaced fields is to select a character set in which the uppercase characters, for example, have an even number of pels in the vertical strokes. The disadvantage of this technique is that VDU users may not wish to be constrained to use a particular character set especially where this may require changes to be made to a character generator ROS.

Yet another approach to solving the problem is described in IBM Technical Disclosure Bulletin, Vol. 21, No. 4, September 1978 at page 1675 entitled 'Flicker Reduction in Interlaced CRT Data Displays' by J. H. Boal and B. F. Dowden. In this case, there is no restriction on the choice of character design, but the display control system functions to ensure that the display of alternate rows of characters is 'started' in alternate interlaced fields. This method has the merit that it places no restriction on the character set which may be designed for optimum character discrimination or have some particular stylistic attributes. A disadvantage in this case is that the operational constraint on the display system which can result in non-uniform line spacing. Furthermore, both of the latter references describe methods which although serving to reduce the flicker are essentially only partial solutions.

SUMMARY OF THE INVENTION

A raster-scanned CRT display device according to the present invention is provided with auxiliary deflection means operable in the vertical scan direction to displace the beam to positions lying between the scan lines of the CRT raster. The scan line pitch of the CRT raster is controlled to be twice the required pel spacing of the image to be displayed on the screen and the auxiliary deflection means when energized displaces the scanning beam from this raster (in one embodiment) by half a pel pitch in one direction or the other. It can be seen that with this arrangement, the image scan lines defined on the screen by the deflected beam together constitute an image raster of the desired pel pitch necessary to display the image.

In operation, two basic field scans of the raster are required to produce a complete image frame as is the case with conventional interlace system. However, the basic scanning raster is the same for the two field scans constituting the image frame. Logic circuits control auxiliary vertical deflection of the beam at video rates onto the associated upper or lower image scan line of the image raster during each single horizontal scan of the basic raster and also control the modulation of the spot brightness so as to display the pels representing the image solely on the image raster lines.

The logic circuit functions dynamically at the video rate to determine which field successive groups of pels, representing predetermined portions of the input image video, are to be displayed. In one embodiment of the invention, the predetermined portion of the image, only includes a single pel from each of two consecutive image rows. In a second embodiment, it includes all the pels in two complete consecutive image rows. In a third embodiment, the predetermined portion includes the pels forming individual character blocks in two consecutive image rows. Briefly, the decision is made by the control logic as to whether a predetermined number of image pels on a line required to represent a corresponding portion in the image currently being displayed, are to be displayed during the first or the second field of the frame. Since this system enables pels in the same image lines to be generated in either field, it is possible to distribute the pels between the fields so that any accumulative imbalance of pels between the fields is kept to a minimum. The control logic operates during scanning to supply control signals to the auxiliary deflection means and brightness control of the CRT to perform this distribution of pels between the fields. Thus, although the basic raster scan is identical for each field, the electron beam traverses a different 'dither' path in each field in order to produce the image.

Where the decision concerning distribution of image pels between the two fields is made on a pel-by-pel basis, the accumulative pel imbalance between the two fields at the end of a frame is never greater than one pel.

Where the field selection is based on a larger group of pels, for example, character by character, the accumulative imbalance between fields at the end of a frame is never greater than the number of pels representing the maximum width of a character or, in other words, never greater than the maximum number of pels between consecutive character gaps in an image row. Where the field selection is based on pels taken a line at a time, then the accumulative imbalance between fields never exceeds the maximum pel count for a line and generally will be less.

The invention therefore has the considerable advantage over the prior art in that, depending on the size of the group of input pels selected at a time for allocation to one field or the other, accumulative imbalance of pels between fields as a result of pel distribution of each group is always a minimum. The apparatus functions irrespective of the data content of the input video to realize the full advantage of an interlaced system. Furthermore, because the energized pels are field equalized or nearly field equalized, there is little or no frame frequency ripple on the power supply driving the CRT thus allowing better regulation or the use of cheaper components.

BRIEF DESCRIPTION OF THE DRAWINGS

In order that the invention may be fully understood, preferred embodiments thereof will be described with reference to the accompanying drawings. In the drawings:

FIG. 3 shows the allocation of image pels to two field scans producing a typical image on the screen of the device shown in FIG. 1.

DETAILED DESCRIPTION

Figure 1:
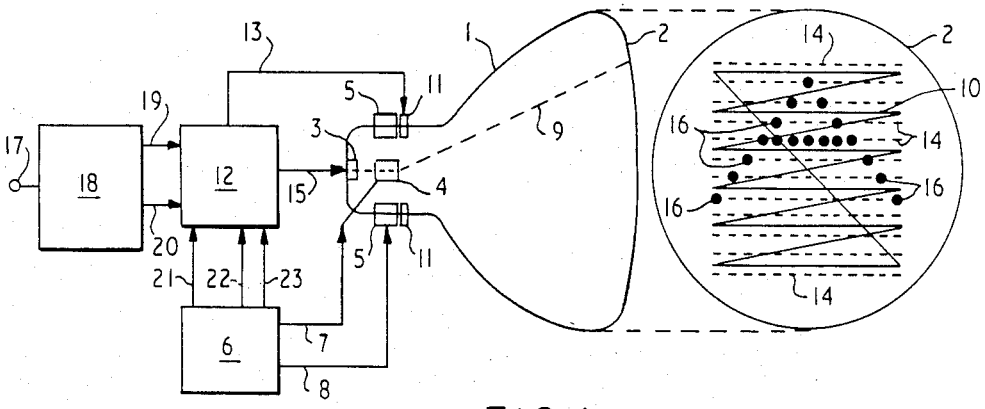
FIG. 1 shows a raster-scanned CRT display device according to the invention together with an illustration of the formation of a simple image on the screen of the device.

FIG. 1 shows in schematic form a raster-scanned CRT display device incorporating the present invention and, to its right, an illustration of the structure of a simple image displayed on the screen of the device. The display device consists of a conventional CRT 1 having a screen 2, an electron gun 3, and horizontal and vertical deflection coils 4 and 5 respectively. Horizontal and vertical deflection circuits 6 are operable to supply horizontal scan control signals over line 7 to coils 4 and vertical scan control signal over line 8 to coils 5 to cause an electron beam 9 from gun 3 to scan the screen 2 repetitively, in a predetermined raster 10.

CRT 1 differs in structure from a conventional device in that it is provided with auxiliary vertical deflection means 11 operable to deflect the electron beam by small constant amounts to positions on one side or the other of the scan lines of the basic raster 10. The deflection means 11 may be provided, as in this example, by electrostatic plates energized by vertical deflection signals of appropriate polarity supplied from control logic 12 over line 13. Alternatively, if circumstances permit, the deflection means 11 may be provided by magnetic deflection coils, or even by means for directly modulating the vertical scan control signals supplied over line 8 to generate the basic raster 10. The magnitude of the deflection signals are selected such that lines 14 (shown dashed in FIG. 1) drawn through all possible deflected positions on each side of the basic raster 10 are uniformly spaced over the screen 2 in the vertical scan direction. The control logic 12 also supplies output video signals over line 15 to modulate the brightness of electron beam 9 in order to display the required image.

In use, images are generated as a plurality of pels 16 generated by the beam solely when displaced from the basic raster onto image lines 14. These image lines when taken together may be regarded as constituting an image raster. It is seen that in terms of an image to be displayed, the scan lines of the basic raster 10 are at twice the pel spacing of the image and the vertical displacement from the basic raster to image lines 14 is equal to half a pel spacing. Timing control of the logic 12 is provided in the video clock signals at the pel frequency supplied over line 21 from deflection circuits 6 and a binary level signal indicating first or second field scan of each frame supplied over line 22 also from circuit 6. An end of field signal is supplied over line 23. The generation of these timing signals is quite conventional and will not be described herein.

Input video information representing an image is supplied serially to terminal 17 from where it is loaded and stored in refresh buffer 18. The individual lines of the image are required to be displayed in corresponding lines 14 of the image raster on the screen. In order to achieve this, two successive field scans of the basic raster 10 are required. Since pels can be written in either the upper or the lower image line during each horizontal scan of the basic raster, the function of the control logic 12 is to determine for each individual pel in each image line 14 whether it is to be displayed during the first or the second field scan of the image frame. The determination of field allocation for the pels is made having regard to the information content of the input video information representing successive pairs (L0, L1) of image lines. Thus, the input video information representing the first and second lines of the image is clocked one pel at a time at the CRT clock rate over lines 19 and 20 respectively into control logic 12. The clocking of each pair of lines is in synchronism with the associated horizontal scan line of the raster controlled by video clock signals at the pel frequency supplied over line 21 from deflection circuit 6.

During scanning of each horizontal scan line of the raster 10, selected pels are written in one or other or both of the corresponding two image lines 14 under control of logic 12 supplying appropriate deflection signals to the deflection plates 11 and modulation signals to the beam brightness control. As each line of the raster 10 is scanned, the input image video information representing the corresponding pair of image lines is clocked into control logic 12. The logic functions on-the-fly to cause selected pels to be displayed in the corresponding two lines 14 on the screen to attempt to maintain equality of pel distribution between the fields. The process is continued for the entire raster scan of the screen for the first field and then repeated for the second field scan during which time the control logic controls the display of the remainder of the pels forming the complete image. A binary signal supplied from deflection circuit 6 to control logic 12 over line 22 indicates by its level, the current field of the frame being scanned. The distribution of pels between these two fields is contolled by the control logic 12 in accordance with the invention so that at the completion of an image frame, the number of pels in each of the two fields is identical or differ by only one pel.

Figure 2:
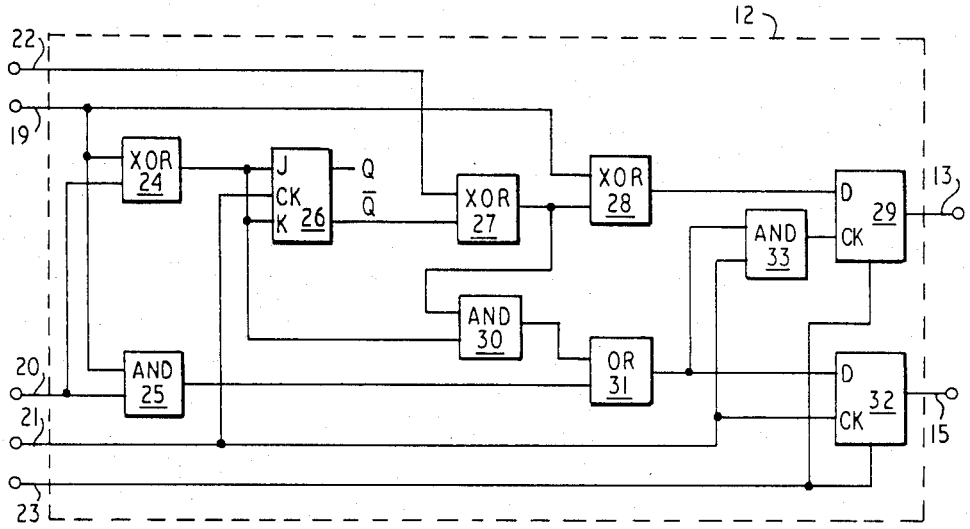
FIG. 2 shows details of the control logic forming part of the device shown in FIG. 1.

The construction and operation of the control logic 12 will now be described with reference to FIG. 2. In this figure, the input and output lines bear the same reference numerals as the corresponding lines in FIG. 1. At the input side of the control logic, the video clock waveform is provided on line 21 as a series of positive pulses supplied at the pel rate. The field identification signal on line 22 is selected to be 'down' during the first field (field A) scan and 'up' during the second field (field B) scan of each image frame. A positive signal produced during fly-back at the end of each field is supplied on line 23. Binary coded video information representing the image content of corresponding pel positions in the current pair of image rows (L0, L1) is supplied to input lines 19 and 20.

These two input lines are both connected as inputs to XOR gate 24 and also to AND-gate 25. The output from XOR gate 24 is connected to both J and K inputs of control latch 26. The control latch 26 is reset at the end of each complete field scan by the end of field pulse supplied over line 23. Thereafter, an unbalanced input on lines 19 and 20 indicating the presence of a pel in one line position but not in the corresponding position in the other line, provide the input conditions which result in the latch output being switched. Switching is triggered by the trailing edge of the next clock pulse supplied to the clock input over line 21. The function of the control latch therefore is to keep track of the allocation of pels to the two fields. Thus, if the latch is in its 'reset' state, then the number of pels currently allocated are the same for each field. The fields are then said to be balanced. If the latch is in its 'set' state then one more pel has been allocated to the A field than to the B field and the fields are said to be unbalanced.

The $\overline{Q}$ output of the latch is connected as one input to XOR gate 27 and the field line 22 is connected as a second input. The output from XOR gate 27 is connected as one input to XOR gate 28 and image line 19 is connected as a second input. The output from XOR gate 28 is connected to the D-input of deflection latch 29 which provides the control signals on line 13 to control the auxiliary vertical deflection of the beam. A positive output from this latch is effective to deflect the beam 'down' to the second of the two image lines associated with the current scan line of the basic raster, a zero output is effective to deflect the beam 'up' to the first of the two image lines.

The outputs from XOR gate 24 and XOR gate 27 are supplied as inputs to AND-gate 30. The output from AND-gate 30 is connected as input to OR-gate 31, the other input of which is connected to the output of AND-gate 25. The output from OR-gate 31 is connected to the D-input of video latch 32 which provides the control signal on line 15 to modulate the beam brightness and so write pels on the screen. A positive output from this latch causes a pel to be written on the screen.

The provision of latch 29 to supply the deflection control signal results in the electron beam remaining in the deflected position until the state of the latch is switched to deflect it to the opposite position. Thus, during operation, the beam is always in one or other deflected states or in transition between states. Clearly, an alternative to this approach would be to dispense with the latch 29 and permit the deflected beam to relax to the scan line of the basic raster following the display of the current pel. In the preferred embodiment, the provision of latch 32 is merely to equalize the timing of the deflection and video portions of the control logic. The outputs of both latches are clocked by the trailing edge of the next occurring clock pulse. In order to ensure the synchronization of the beam deflection and pel writing, a clock pulse from line 21 is only supplied to latch 29 when it coincides with an output representing a video signal from OR-gate 31. The gating function is preferred by AND-gate 33.

There are four possible input conditions which can occur on lines 19 and 20.

1. Input (0,0). This input indicates that there are no pels in the current position in either line of the current pair of lines. The outputs of AND-gates 25 and 30 are both down and no video control signal is supplied from latch 32 on line 15.

2. Input (0,1). This unbalanced input indicates that there is no pel in the current position of the first image line supplied on line 19 but there is a pel in the corresponding position of the second line of the pair supplied on line 20. This condition requires that a pel be written in the corresponding image line in either field A or field B. If the control latch 26 is in its 'reset' state, then the pel is displayed during the A field scan. If the latch is in its 'set' state, then the pel is displayed during the B field scan.

3. Input (1,0). This unbalanced input indicates that there is a pel in the first image line but no pel in the second image line. Again, a single pel must be written in the corresponding image line in either field A or field B. The field allocation is precisely the same as in the previous example.

4. Input (1,1). This balanced input indicates that a pel exists on both lines 19 and 20. The logic responds in this case to cause a pel to be displayed on both image lines, one during the A field and one dufing the B field.

The operation of the control logic 12 is summarized in the table below in which X equals don't care state, A equals display in field A, and B equals display in field B.

TABLE 1

| Field | Control Latch 26 Output | Image L0 | Line L1 | Control Latch 26 State | Deflection | Video |
|---|---|---|---|---|---|---|
| X | X | 0 | 0 | — | X | OFF |
| A | 0 | 0 | 1 | SET | DOWN | ON |
| A | 0 | 1 | 0 | SET | UP | ON |
| A | 0 | 1 | 1 | — | UP | ON |
| A | 1 | 0 | 1 | RESET | X | OFF |
| A | 1 | 1 | 0 | RESET | X | OFF |
| A | 1 | 1 | 1 | — | DOWN | ON |
| B | 0 | 0 | 1 | SET | X | OFF |
| B | 0 | 1 | 0 | SET | X | OFF |
| B | 0 | 1 | 1 | — | DOWN | ON |
| B | 1 | 0 | 1 | RESET | DOWN | ON |
| B | 1 | 1 | 0 | RESET | UP | ON |
| B | 1 | 1 | 1 | — | UP | ON |

A practical example of the allocation of image pels to the A and B fields is shown in FIG. 3. From this figure it can be seen that the maximum pel difference for each pair of input image lines (L0, L1) is one and that the total difference for the whole frame is not more than one.

The embodiment described above allocates image pels to the A or B field on a pel-by-pel basis. Thus, as has been shown in FIG. 3, display of a single pel horizontal line is achieved by allocating alternate pels in each of the two fields resulting in completely balanced fields. In a conventional CRT interlace system, display of a single pel wide horizontal line can only be achieved by allocating all the pels to one field which produces flicker at the frame frequency. The apparatus of this embodiment has the advantage that the flicker caused by a pel imbalance between the two effectively interlaced fields A and B constituting the frame is reduced to a minimum and is independent of the source image structure.

In the second embodiment of the invention described hereinafter with reference to FIG. 4, the allocation of image pels to the A or B field is made on a line-by-line basis which eases the switching requirements of the deflection circuits. Although it is unlikely that the pel contents of the two fields will be precisely balanced at the completion of a frame scan, the control logic 12 (FIG. 1) again operates, as will be seen, to keep any pel imbalance at a minimum.

Details of the control logic 12 incorporated in the second embodiment of the invention will now be described with reference to FIG. 4. In this figure, the input and output lines bear the same reference numerals as the corresponding lines in FIG. 1. Although the principle of operation of the control logic 12 in this embodiment is basically the same as that of the control logic shown in FIG. 2, the various differences in structure required to perform the pel allocation on a line-by-line basis dictate that new references should be used for the sake of clarity, even where corresponding components exist in the two figures.

The input image lines 19 and 20 are connected as inputs to XOR gate 34 which provides a signal at its output whenever there is an imbalance between the input pels ($L0 \neq L1$). Output pulses from XOR gate 34 indicating pel imbalance are gated through AND-gate 35 by pel clock pulses supplied on line 21 to increment or decrement up/down counter 36. The direction of count is arbitrarily determined by the signal on line 37 connecting input line 20 to the counter up/down count control. The arrangement in this embodiment is such that the counter 36 is incremented for input condition $L1 \cdot \overline{L0}$ and is decremented for condition $L0 \cdot \overline{L1}$.

The counter 36 therefore contains a continuous record of the difference in on-pel count ($L1-L0$) for the pair of image lines (L0, L1) being clocked into the control logic. A sign bit supplied on counter output line 38 indicates the sign of the counter contents and therefore which line L0 or L1 contains the greater number of on-pels. The notation is such that a positive signal on line 38 indicates that the condition where there are more pels on the L0 line than the L1 line ($L0>L1$) whereas a zero signal indicates the opposite condition ($L1>L0$). The counter is reset by a timing pulse (t2) supplied from timing control 39 over line 40 before the start of the next line scan of raster 10.

The input lines 19 and 20 are further connected respectively to line buffers 41 and 42. The image data emerging from the buffers is consequently delayed by one image scan line. This line delay is clearly necessary since the decision as to which field the pels representing each image row are to be allocated cannot be made until all the pel positions in the current pair of rows has been analyzed by counter 36. At the end of each line scan the contents of counter 36 are applied in parallel over data bus 43 to a first set of inputs of adder/subtractor 44. The contents of a field register 45 are also supplied to a second set of inputs of adder/subtractor 44 in parallel over data bus 46. The transfer of the contents of the register 45 occurs during line flyback time under control of timing pulse (t1) supplied over line 47 from timing control 39. The control of the add or subtract function of adder/subtractor 44 depends on the field allocation of the pels forming the row selected for display, as will become clear later. The result of the arithmetic operation performed by adder/subtractor 44 is a numerical record of the difference in number of pels currently allocated to the two fields. The result is written back into the field difference register 45 over line 48. A sign bit from register 45 on line 49 indicates which of the two fields currently has been allocated the most pels. The selected notation is such that a positive signal on the sign line indicates the allocation of more pels to the current field being scanned from the L0 line of the input image pairs. The sign bit on line 49 is inverted for convenience by inverter 50 and connected over line 51 to the D input of field balance latch 52. The balance latch is set by a timing pulse (t0) provided over line 53 from timing control 39 again during line flyback after the analysis of the contents of the current pair of image lines. The timing pulses (t0) (t1) and (t2) in fact all occur during line fly-back and in that order.

The output from the balance latch 52 represents the current state of pel allocation between the A and B fields. Following the invertion of the sign bit by inverter 50, the notation is such that the output from latch 52 is positive for the condition when the sum of the L0 bits exceeds the sum of the L1 bits in the current field. The output from latch 52 is connected over line 54 as one input to XOR gate 55. The sign bit line 38 from counter 36 is connected as a second input. The output signals appearing from XOR gate 55 on line 56 are connected to the add/subtract control of adder/subtractor 44 and the signal output on this line is used to control its operation so as to maintain a current field allocation count in field register 45. Thus, a positive output from XOR gate 55 on line 56 causes the adder/substractor 44 to subtract the contents of counter 36, representing the pel imbalance for the pair of lines last scanned, from the contents of the field difference register 45, representing the current pel imbalance between the two fields for the portion of the image processed prior to the pair of lines last scanned.

The output line 56 from XOR gate 55 is further connected as one input to XOR gate 57. Field line 22 is connected as a second input. The output from XOR gate 57 is connected over line 58 to the D input of latch 59. The output from latch 59 is connected to the auxiliary vertical deflection line 13 (FIG. 1) where, as in the previous embodiment, a positive output signal results in the beam being deflected 'down' and a zero output signal results in the beam being deflected 'up'. Line buffers 41 and 42 are connected over lines 60 and 61 respectively to inputs of funnel 62. Funnel 62 is operable under control of the output condition from latch 59 to select one or other line of pels for display in the current field. The arrangement is such that the L0 pels input on line 19 are channelled through funnel 62 onto the video line 15 when the output signal from latch 59 is positive. The L1 pels input on line 20 are channelled through the funnel onto video line 15 when the output from latch 59 is zero.

In summary, data lines L0 and L1 are analyzed by counter 36 to determine the difference of the on-pel count ($L1-L0$). At the end of every line the balance latch 52 is set from the sign bit of the field difference register 45 which together with its sign bit indicates the excess number of pels plotted in the A field over the B field. The XOR gate 55 and 57 define respectively the direction of deflection either up or down and the line (L0 or L1) selected for display. For example, if the pels allocated for the A field exceed those allocated for the B field and if there are less L0 pels than L1 in the line buffers 41 and 42, then the contents of the L0 line buffer 41 is the one selected to control the video on line 15 and the deflection signal on line 13 will cause the beam to be deflected to the upper image line 14 of the pair. After the balance latch is set then the field difference register 45 is updated by adding/subtracting the count from up/down counter 36. The effect will always be to change the value towards zero resulting in as near pel balance between the two fields as is possible for the data content of the image being displayed.

The example shown in Table 2 below illustrates the operation of the control logic of this second embodiment in response to six pairs of input image lines representing a portion of a typical image.

TABLE 2

| Input pair No. | Counter 36 (L1-L0) | Balance Latch | XOR Gate | Decision | Add/ Subtract Control | Field Diff. |
|---|---|---|---|---|---|---|
| 1 | −342 | SET | 1 | L0/Field A | Subtract | +342 |
| 2 | −343 | RESET | 0 | L0/Field B | Add | −1 |
| 3 | −350 | SET | 1 | L0/Field A | Subtract | +9 |
| 4 | +200 | RESET | 1 | L0/Field A | Subtract | −191 |
| 5 | +100 | SET | 0 | L0/Field B | Add | −91 |
| 6 | +100 | RESET | 0 | L0/Field B | Add | +9 |

The sign of the field difference is used as explained previously to set and to reset the balance latch to switch the fields for display as required. It is seen from the field difference column which contains the running total of pels allocated to the two fields, that the number tends towards zero irrespective of input condition thus keeping the pel imbalance between fields at a minimum.

In the first embodiment of the invention, the decision as to which field the input image pels are to be displayed is made one pel at a time as the current pair of input lines are clocked into the control logic. In the second embodiment, the decision is delayed until the entire pel content of the current pair of input lines has been analyzed. Thus, for a line of 720 pels length, an eleven bit counter (10 bits plus sign bit) and two 720 bit shift registers for the line buffers are required to accommodate the pels in a row. The timing pulses (t0), (t1) and (t2) are all generated as a series of pulses during each line flyback. Following the analysis of the lines, the control logic selects the field during which all the pels in one of the lines is to be displayed. Clearly, in this embodiment, single pel wide lines will be displayed in a single field. However, the logic operates so that adjacent single pel horizontal lines for example are displayed in different fields, so equalizing the overall pel distribution.

Figure 4:
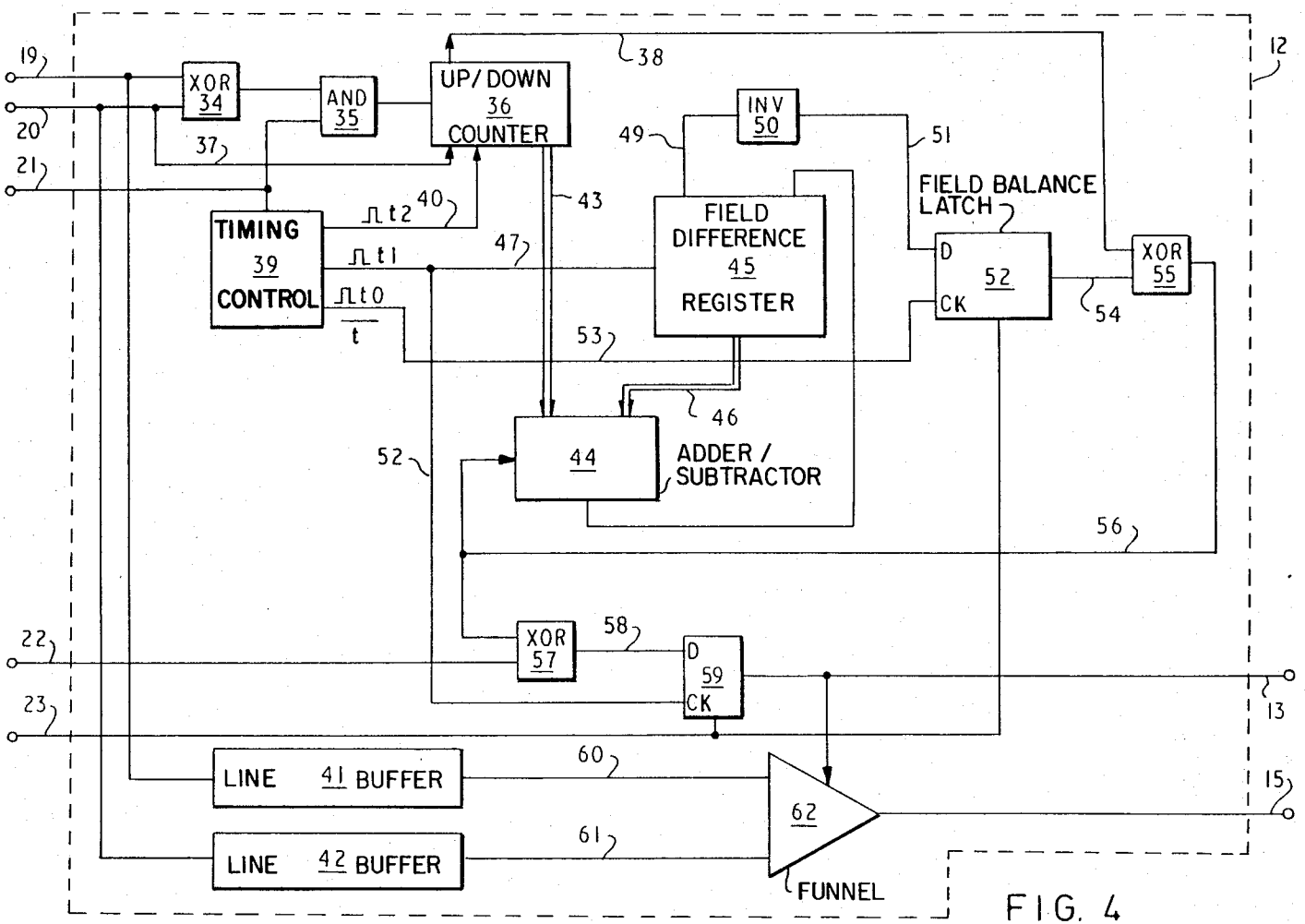
FIG. 4 shows details of an alternative control logic forming part of the device shown in FIG. 1.

A simple modification to the control logic shown in FIG. 4 enables the decision to be made on a character-by-character basis. This modified embodiment is particularly useful for text display systems such as the IBM 3730 Text Display Station in which all characters are displayed in 7 pel wide character cells separated by 2 pel wide character spaces, making a total character block 9 pels wide. In the control logic 12 shown in FIG. 4, the counter 36 and lines buffers 41 and 42 must be capable of accommodating the total number of pels in a single line. The only changes to the control logic required to enable it to operate on a character-by-character basis is to reduce the size of counter 36 and line buffers 41 and 42 to accommodate the pels in a character cell and to modify the timing. In order to handle the 9 pels wide character blocks, a 5 bit counter is required (4 bits plus sign bit) and two 9 bit shift registers for the line buffers are required. The same three timing pulses (t0), (t1) and (t2) are required to control the operation of the device but now they are generated again by conventional means by timing control 39 in each character gap along the scan line.

It will be appreciated that this arrangement for allocation of pels to fields character-by-character where the characters are all based on fixed sized character cells equally spaced along a display line, can be extended to proportional spaced display systems where inter-character spaces are irregularly distributed. In this case, a look-ahead system is incorporated it identify the location of the next character gap and to produce the timing pulses (t0), (t1) and (t2) in the gap when it is reached during data analysis. Details of such a system are not described herein but, since the principle of operation is unchanged, such a system falls within the scope of the present invention.

In all the embodiments described hereinbefore, the image raster represented on the screen by the uniformly spaced image lines 14 is produced by deflecting the basic raster 10 either 'up' onto one of a pair of the image lines or 'down' onto the other of the pair associated with the current scan line of raster 10. Clearly, the same result on the screen can be achieved by only deflecting the basic raster 10 in one direction to define one line 14 of the image raster lying in this case mid-way between two adjacent scan lines of the basic raster 10. The other image scan line forming the image pair is provided by the scan line of the basic raster itself. This arrangement is not the preferred arrangement but clearly falls within the scope of the present invention.

While the invention has been particularly shown and described with reference to preferred embodiments thereof, it will be understood by those skilled in the art that various changes in form and detail may be made therein without departing from the spirit and scope of the invention.

Having thus described my invention, what I claim as new and desire to secure by Letters Patent is:

1. The method of reducing perceived flicker in a CRT display device comprising an electron gun, a display screen, horizontal and vertical deflection means operable to cause an electron beam from said gun to be scanned over said screen progressively in successive basic raster scan lines in successive fields of a predetermined basic raster, and modulation means operable in response to input video information defining a two-dimensional image to modulate the brightness of the beam scanning to produce individual visible picture elements (pels) on the screen, a representation of said two dimesional image being formed thereby as the combination of pels produced during two successive field scans of the basic raster, characterized in providing auxiliary deflection means operable to deflect the beam transversely of the line scan direction of the basic raster during each basic raster line scan thereof to a currently selected one of a pair of adjacent image scan lines on the screen corresponding to the current basic raster scan line, the image scan lines corresponding to the totality of the basic raster scan lines being spaced apart on the screen and constituting an image raster of twice the line density of said predetermined basic raster, determining in which of the two successive field scans the pels representing selected portions of said image are to be displayed, and controlling said auxiliary deflection means in accordance with the physical distribution of successive pels to be generated with respect to the timing of generation of pels by said modulation means whereby any accumulative pel imbalance between the two fields as a result of the pel distribution is minimized.

2. The method of reducing perceived flicker in a CRT display which comprises:

providing first and second successively executed basic raster patterns for said CRT;

designating an image line raster pattern for the screen of said CRT;

providing means to deflect said beam from at least one of said basic raster patterns so as to enable positioning of said beam at one desired point of a pair of point of a progressive succession of pairs of such points on said image line raster pattern while executing either said first or second basic raster pattern, said succession of pairs of points being positionally related to locations along said basic raster patterns as said basic raster patterns are executed; and operating said means to deflect said beam so as to position said beam for display of a desired pel on said image raster pattern selectively while executing either a said first or a said second basic raster pattern;

the selection of the basic raster pattern for display of said pel being made on the basis of examination of the pel populations displayed during the respective said basic raster patterns elsewhere in said screen so as to tend to make said pel populations equal.

3. The method of claim 2 wherein the selection of the basic raster pattern for the generation of a given pel is made by generating an indication of the allocation of pels on said screen to the respective basic raster patterns.

4. The method of claim 3, wherein the means to deflect is operable on the raster lines of each of said basic raster patterns, in each case to deflect said beam to either side of the basic raster line, and the lines of said image raster lie between the lines of said basic raster patterns.

5. The method of claim 3 wherein the generation of said indication is by the providing of a history of previously examined pel pairs.

6. The method of claim 4 wherein the generation of said indication is by the providing of a history of previously examined pel pairs.

* * * * *